United States Patent [19]

Minshall

[11] Patent Number: 4,665,838

[45] Date of Patent: May 19, 1987

[54] SHELVING UNIT

[76] Inventor: Aubrey W. Minshall, 3069 Wolfedale Road, Mississauga, Ontario, Canada, L5C 1V9

[21] Appl. No.: 780,183

[22] Filed: Sep. 26, 1985

[51] Int. Cl.[4] ..... A47B 47/00

[52] U.S. Cl. ..... 108/111; 108/153; 211/186; 403/217; 403/231

[58] Field of Search ..... 108/111, 153, 157; 211/186, 189, 191, 206; 403/217, 219, 231

[56] References Cited

U.S. PATENT DOCUMENTS

| | | | |
|---|---|---|---|
| Re. 28,244 | 11/1974 | Evans | 108/111 X |
| 2,380,379 | 7/1945 | Attwood | 211/189 X |
| 3,244,127 | 4/1966 | Evans | 108/111 X |
| 3,261,309 | 7/1966 | Kinnear | 108/156 |
| 3,393,521 | 7/1968 | Cammisa | 211/186 X |
| 3,494,478 | 2/1970 | Link | 211/189 X |
| 3,897,876 | 8/1975 | Feldman | 211/189 X |
| 4,078,664 | 3/1978 | McConnell | 108/111 X |
| 4,093,167 | 6/1978 | Rooklyn | 108/153 X |
| 4,564,111 | 1/1986 | Suttles | 108/111 X |

*Primary Examiner*—Kenneth J. Dorner
*Assistant Examiner*—José V. Chen

[57] ABSTRACT

A shelving unit according to the present invention provides a generous span between opposed end frames and a clear lower area to allow the hood portion of a car, for example, to be located below the first shelf. The frame of the unit is preferrably made of rolled steel components of similar cross-section joined together in a manner to reinforce each component. It is preferred that each component be of a generally rectangular shape open on one side to have a "U" shaped channel.

8 Claims, 7 Drawing Figures

SHELVING UNIT

BACKGROUND OF THE INVENTION

The present invention relates to shelving units and particularly shelving units having a large span between opposed vertical uprights.

In the past, a number of shelving units have been proposed for household use to increase useable storage. In particular, metal shelving units which are mechanically secured are common, and the actual shelf is made of rolled steel to be self-supporting intermediate the end frames of the shelving unit. When the span between the upright members increases, it becomes increasingly difficult to have the shelf self-supporting as the thickness thereof and the reinforcing required becomes prohibitive. Large spands, therefore, to date have not been possible in a lower cost simple shelving structure.

A shelving frame unit according to the present invention, has a large span between vertical upright members of at least about six feet. According to an aspect of the invention, the components are of "U" shaped cross-section. The components cooperate to reinforce one another at the connection between horizontal rail members used to support the shelving intermediate the end frames, the upright member and an associated cross-member which is part of the end frame. In effect, one of the rails or cross-members closes the "U" shaped section of the upright member and has an end configuration for straddling the upright on opposed sides thereof. The other member engages the bottom of the "U" shaped section of the upright member and has a further tongue perpendicular to the longitudinal axis of the member for engaging the other member along a surface thereof. In this way, all components are interconnected and the "U" shaped cross-sections of the components are reinforced by the junction.

According to a further aspect of the invention, racking between the end frames is minimized due to gusset members or bracing means between the upright members and at least some of the horizontal rail members. If racking in the direction of the end frame is a problem, further gusset members may be provided.

The shelving frame is particularly suitable for the garage to allow the front of a car to be below the shelves.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
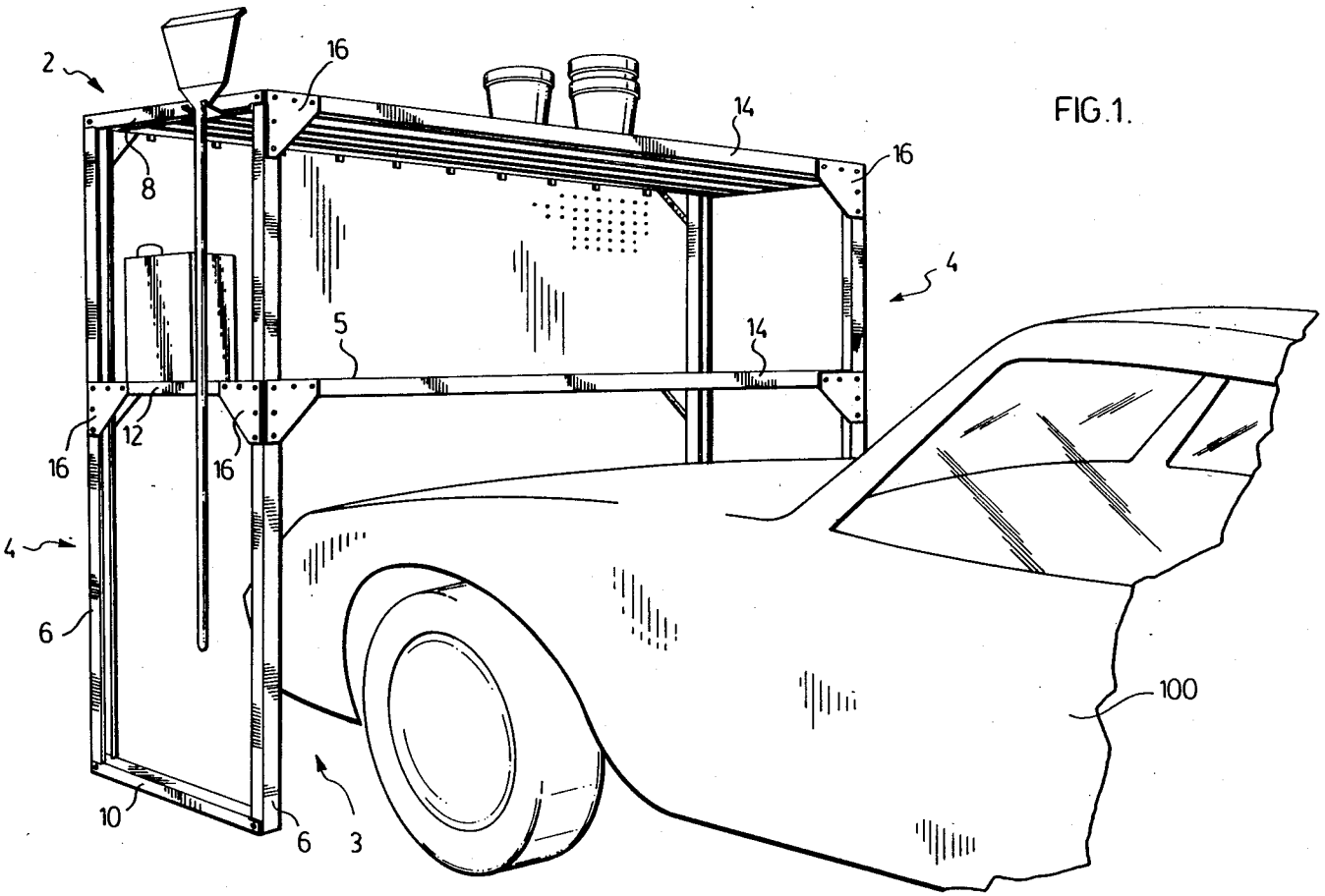
FIG. 1 is a partial prespective view of the framing unit.

The shelving unit 2 of FIG. 1, has an open bottom area 3 for receiving the front portion of a car 100. As can be appreciated this requires a substantial spread between the rectangular end frames generally shown as 4, and preferably the area beneath the lower of the two front rails 14 is clear. Thus, the end frames are first joined, at least adjacent the front edge of the shelving unit, by the horizontal members extending between the rectangular frames 4 at the level of the first shelf 5. Each end frame 4 includes spaced upright members 6 interconnected by an upper horizontal cross-member 8, a lower horizontal cross-member 10 and an intermediate horizontal cross-member 12. The end frames are interconnected by front rails 14, back rails 18 and intermediate rails 20 shown in FIG. 2. The front rails, back rails and intermediate rails are all at the same level and cooperate to support the relatively thin sheet metal shelving pans 44*a* and 44*b* shown in FIG. 2. The shelving pans are joined intermediate their length by the plastic extruded joiner 46. To reduce racking between end frames, i.e. changes in the perpendicular orientation between the upright members 4 and the rail members 14, 18 and 20, a number of gussets 16 are secured to, and intermediate, the upright member and the front or back rail or both. Gussets 16 acts a bracing between these components to maintain the perpendicular orientation of the rails relative to the uprights 6. Racking is particularly troublesome with this type of system, where it is desired to maintain at least the lower front portion substantially free by providing a clear space between the floor level and the first shelf level to allow the front portion of the car to be positioned between the end frames 4 and below the lower rails 14, 18 and 20. If necessary, gussets 16 may also be provided between the uprights 6 and the cross-members 12, however, racking in the plane of the end frames is not as significant as further horizontal members could be provided, and the lower horizontal cross-member 10 closes the frame.

The upright 6, the various cross-members and the various rails are of the same cross-section which is generally "U" shaped and fabricated from rolled steel. The open portion of the "U" does include inwardly directed flanges or lip edge regions 52 and 54, shown in FIG. 6. These flange or lip regions strengthen the component and also provide a surface for abutting with other members at a connection.

Figure 2:
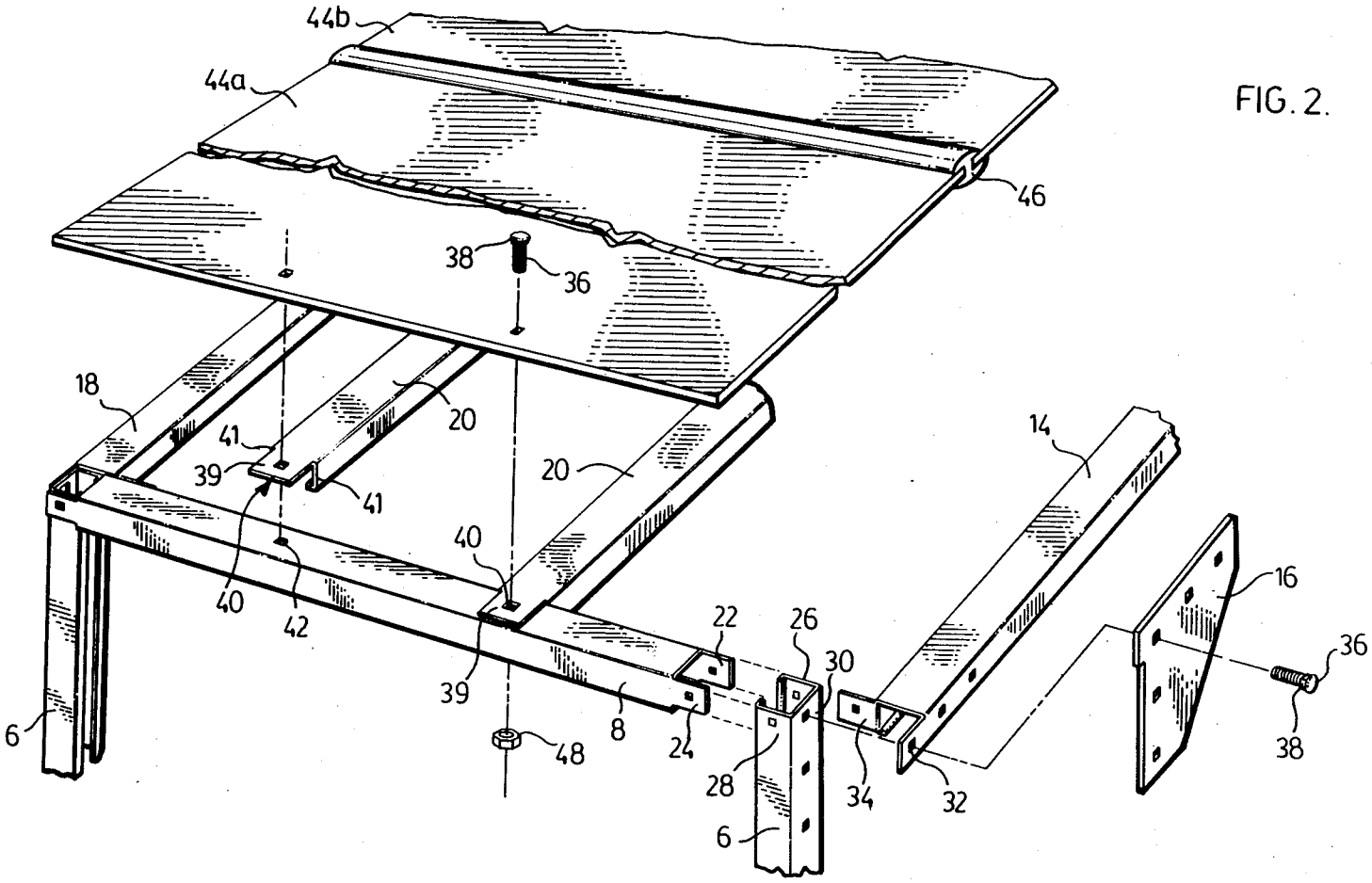
FIG. 2 is a partial perspective exploded view of the framing unit showing the cooperation between the number of components which are secured to one another.

The various structural members 6, 8, 10, 12, 14, 18 and 20 are preferrably of the same material and only differ in the end configuration thereof, which is formed by a die cutting operation. Thus, the same rolls can be used for forming of all components and only the ends need to be modified to distinguish one component from the other. The various end modifications are shown in FIG. 2, where the upper cross-member 8, has opposed tongues 22 and 24 of generally rectangular shape for engaging with the opposed sides 26 and 28 of the upright 6. The tongues 22 and 24 have a square shaped aperture therein, and similarly the upright includes corresponding apertures which will each receive the square shoulder 38 of a bolt 36 used to connect the components. Thus the apertures are noncircular for receiving appropriately shaped shoulders of the bolt to avoid a pivot-type connection. The front rail 14, having tongue 32, engages surface 30 defining the bottom of the "U" shape of the upright member 6 via the tongue 32. The rail 14 includes a further tongue 34 which engages cross-member 8 at a position spaced from the tab 22. In this way, the cross-member 8 closes the "U" shaped cross-section of the upright 6 and the tongue 32 of front rail 14 engages a separate surface of the upright 6 while tongue 34 of rail 14 engages the cross-member at a position spaced from the end thereof. The upright member 6 closes the "U" shaped cross-section of the front rail 14 and reinforces the same, and the cross-member 8 closes the "U" shaped section of the upright. In this way, a very strong mechanical joint is provided between the three components which effectively distributes the load to the upright member 6.

Figure 3:
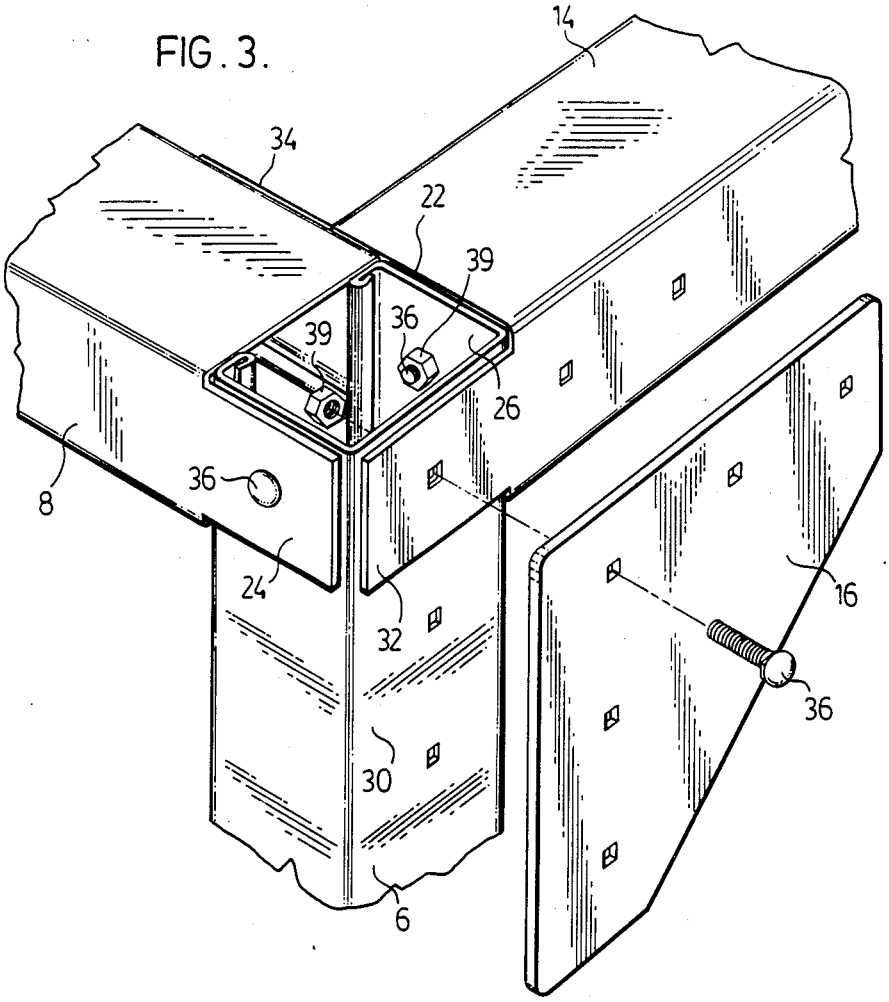
FIG. 3 is a partial perspective view of the joint between an upright member, a cross member and a rail member.

Bracing is provided between the front rail 14 and the upright 6 by the gusset 16, which has five apertures, one of which is used during the securement of tongue 32 to the upright 6 and the remaining four apertures secure the gusset to the rail 14 or the upright at a point spaced from the connection between the rail and the upright. This gusset will provide bracing and will assure the perpendicular orientation of the upright to the rail is maintained. The intermediate rails 20 have a projecting tongue 39 engaging the upper surface of the cross member 8. With edges 41 engaging the inside vertical edge of cross-member 8 to reduce the forces carried by tongue 39 when the shelf is loaded. The tongue 39 includes a square aperture 40 for receiving the square shoulders 38 of the carriage bolt 30, and the shoulders 38 will engage both the aperture in the tongue 39 and the aperture 42 provided in the cross-member 8. The connection of the rails 20 to the cross-members also serves to connect the shelving pan 44*a* to the cross-member. The bolt 36 is engaged by a nut 48 which is received within the "U" shaped section of the cross-member 8. The connection of the front rail 14 and the horizontal cross-member 8 to the upright 6, has been described with respect to the upper shelf of the shelving unit, however, a similar joint is provided at the first shelf level. Details of this secured joint are shown in FIG. 3, where tongue 22 has been mechanically secured by the bolt nut arrangement 36 and 39 to the surface 26 of the upright member 6, and similarly tongue 32 has been secured to the bottom 32 of the "U" shaped cross-section of the upright member 6.

Figure 4:
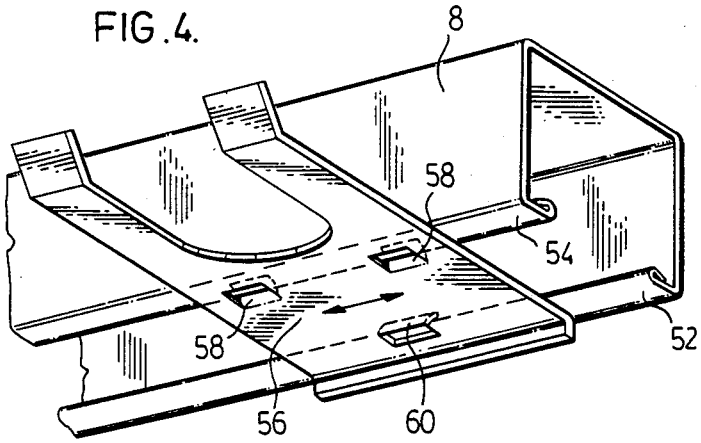
FIG. 4 is a partial perspective view showing an accessory clip suitable for any of the horizontal members.
Figure 5:
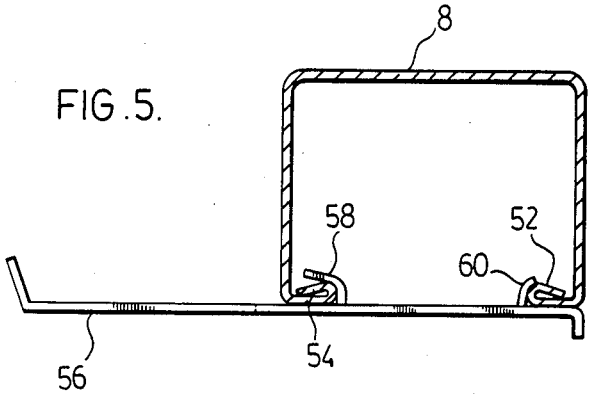
FIG. 5 is sectional view through the clip shown in FIG. 4.

The particular "U" shaped profile of the components used in the present invention is shown in FIG. 4 and includes opposed lips 52 and 54. These lips are advantageously used to stiffen the component and support a tool bracket 56, which can be secured to any of the horizontal members. Once secured, it is slidable along the length of the member, such that the position thereof can be selected by the user. The bracket 56 is secured by tongues 58 which engage the lip 54 and back tab 60 is forced past the lip 52. The lip 54 is initially placed within the space between the tongues 58 and 60 and the bracket is pivoted about lip 54 such that tabs 60 springs past lip 52 to the position shown in FIG. 5.

Figure 6:
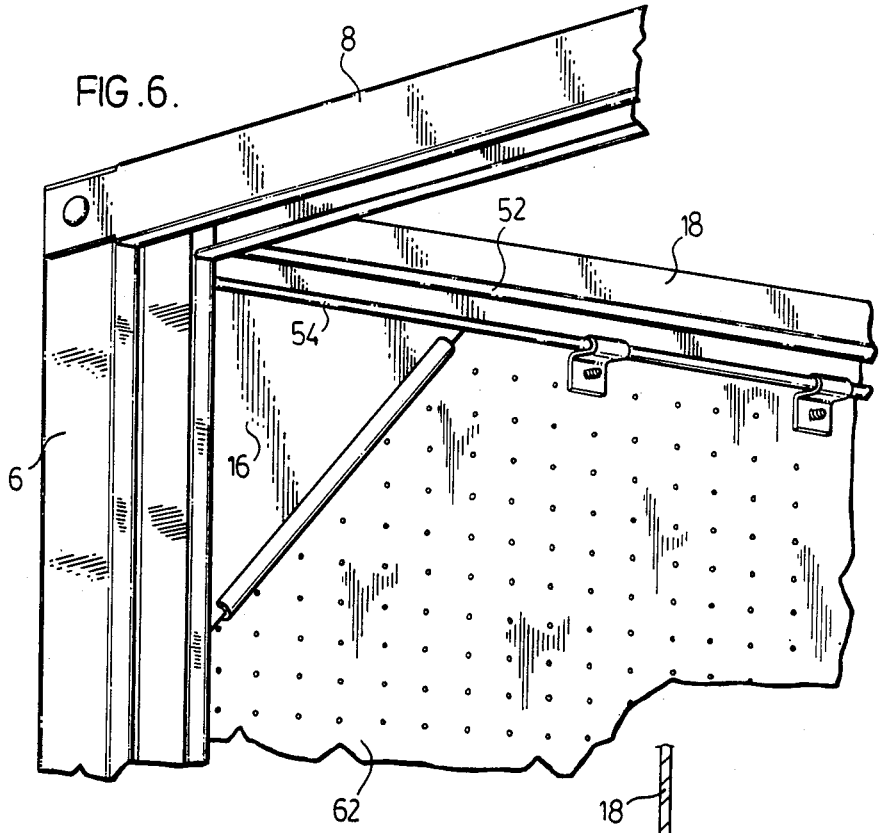
FIG. 6 is a partial perspective view of the shelving frame unit with a securing peg-board at the back surface thereof.
Figure 7:
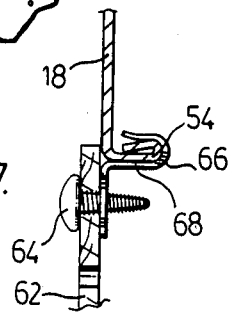
FIG. 7 is a partial sectional view showing the securement of the peg-board.

A further aspect of the invention is shown in FIG. 6 where a peg-board is secured at the back of the shelving unit for support tools in a well known manner. This peg-board 62 is secured by clips 66, which engage the lip 54 of the back rail 18. The peg-board 62 extends behind the gusset 16 and also extends behind the back rail 18 such that a screw can pass through the peg-board as generally shown in FIG. 7 into engagement with clip 66 secured on flange 54 whereby tightening of the screw draws the peg-board against the back surface of the rail 18. A similar arrangement is provided at the lower edge of the back rail 18 which defines the level of the first shelf. In this case, the peg-board 62 extends over and beyond the back rail 18 to expose a lower portion of the peg-board 62 for cooperation with a clip in a similar arrangement to that shown in FIG. 7.

The structure of the present shelving unit advantageously uses the "U" shaped cross-section of the components and the particular orientation of the components to cooperate and allow an effective connection therebetween, with one component reinforcing the other. The particular method of mechanically securing the components together uses non-circular apertures and a bolt having appropriately shaped shoulders for engaging the apertures in a non-pivotal manner. Such an arrangement reduces the possibility of pivoting of the components, although this is even further reduced due to the abutting contact of the components and the use of bracing members.

In some cases a bottom rail can be used to join the end frames 4 at the back and bottom thereof to further strengthen the frame. Additional angled bracing could be used between the back upright and the back rail member. In some cases, a front bottom rail could be used where this component would not be subjected to damage due to the particular use.

In order to effectively use the air space above a car parked in a garage, the shelving unit is about 30 inches wide, has a span of about 8 feet and is capable of supporting about 800 lbs. per shelf. The gauge of the rolled steel members is preferrably in the range of about 0.035 inches to 0.040 inches.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A shelving unit having end frames horizontally separated by at least 5 feet, said end frames each having two vertical uprights secured at the top by an upper horizontal member and at the bottom by a lower horizontal member, said frames connected therebetween adjacent said upper horizontal members, by at least front and back rails, said rails supporting metal sheet material thereabove thereby defining a horizontal shelf;

said uprights, horizontal members and rails all being formed of rolled steel and of generally "U" shaped cross-section; and including brace means between said vertical upright members and said front and back rails, adjacent the junction thereof, to maintain the generally perpendicular relationsip of said rails relative to said vertical uprights, said front and back rails connected to said uprights to be at a height of about three feet and forming the lowest connection between said end frames at least at the front of said shelving unit, said shelving unit below said shelf and intermediate said end frames defining an open front and an unobstructed space between said end frames; and wherein one of said rail and horizontal members includes an end configuration including two parallel and spaced end tabs with each tab secured to said upright and the other of said rail horizontal members including an end configuration having two spaced tabs having a generally perpendicular orientation therebetween with one tab secured to said upright and the remaining tab secured to said member having said two parallel tabs at a position spaced from the end configuration.

2. A shelving unit as claimed in claim 1, wherein said rails, upright and horizontal members, are bolted together.

3. A shelving unit as claimed in claim 1, wherein said bracing means includes triangular shaped gussets each secured between one of said horizontal rails and an adjacent vertical upright.

4. A shelving unit as claimed in claim 1, including a second shelf above said horizontal shelf and supported at the ends by said end frames and supported between said end frames by said front and back rails and shelf support rails, said shelf support rails being positioned intermediate said front and back rails.

5. In a shelving frame unit, a plurality of structural members of essentially the same "U" shaped cross-section and including upright, cross and rail members and a plurality of mechanical securing junctions each interconnecting a rail member, an upright member and a cross-member, one of said rail and cross-members including an end configuration of two opposed parallel tabs sized to straddle opposed sides of said upright member with a portion of said one member between said tabs closing the "U" shaped cross-section of said upright member, the other one of said rail and cross-members having an end configuration with two perpendicular tabs, with one tab engaging said upright member on a planar surface thereof intermediate said parallel tabs and the other tab engaging a surface of said member having said parallel tabs.

6. In a shelving frame unit as claimed in claim 5, wherein said structural members are of rolled steel and interconnected by nut and bolt connections.

7. In a shelving unit as claimed in claim 6, wherein said structural members other than said upright members have end configurations for joining other members formed by die cutting to produce securing tabs.

8. In a shelving unit as claimed in claim 5, wherein said upright members are orientated such that said cross-member when secured thereto, partially closes the "U" shaped cross-section of said upright members.

* * * * *